US005080562A

United States Patent [19]

Barrows et al.

[11] Patent Number: 5,080,562

[45] Date of Patent: * Jan. 14, 1992

[54] ANNULAR ROLLING ROTOR MOTOR COMPRESSOR WITH DUAL WIPERS

[75] Inventors: Kenneth C. Barrows, Liverpool, N.Y.; Thomas P. Gormley, St. Louis, Mo.; Raymond T. Divers, Camillus, N.Y.

[73] Assignee: Carrier Corporation, Syracuse, N.Y.

[ * ] Notice: The portion of the term of this patent subsequent to Sep. 19, 2006 has been disclaimed.

[21] Appl. No.: 448,458

[22] Filed: Dec. 11, 1989

[51] Int. Cl.[5] ..... F04B 35/04

[52] U.S. Cl. ..... 417/353; 418/61.1

[58] Field of Search ..... 417/353; 418/61.1

[56] References Cited

U.S. PATENT DOCUMENTS 4,867,652 9/1989 Gormley ..... 417/353

FOREIGN PATENT DOCUMENTS 0018492 1/1982 Japan ..... 418/61.1
0029789 2/1987 Japan ..... 418/61.1
1379498 3/1988 U.S.S.R. ..... 417/353

*Primary Examiner*—Richard A. Bertsch
*Assistant Examiner*—David W. Scheuermann

[57] ABSTRACT

A rolling rotor motor/compressor is provided with an external rotor/piston which coacts with a bore/cylinder in the housing and one or more vanes to define a rolling piston compressor. Thus, the stator does not form a part of the compression chamber. The compressor can be readily designed for two cylinder or two stage operation.

7 Claims, 7 Drawing Sheets

ON AT OFF

ON BEFORE OFF

ANNULAR ROLLING ROTOR MOTOR COMPRESSOR WITH DUAL WIPERS

BACKGROUND OF THE INVENTION

A rolling rotor motor is one in which only a portion of the windings are activated at any given time and the resultant asymmetric magnetic field is moved around the stator by changing which ones of the windings are the activated windings. This type of motor is characterized by high torque and low speed. Where the rotor is located internally of the stator, the coaction between the rotor and stator as a result of the asymmetric magnetic field, unless otherwise limited, is like that of the piston and cylinder of a rolling piston or reciprocating vane type compressor. As a result, the rotor may also be the piston of a rolling piston compressor such as is disclosed in U.S. Pat. No. 2,561,890. Since the rotor rolls around in contact with the stator, there are low bearing loads as compared to a motor in which the rotor is constrained to rotate about a fixed axis.

The rolling rotor motor can be integral with the compressor thereby reducing the size and number of parts such as shafts and bearings, but it has some inherent disadvantages. Because only some of the windings are activated at any particular time, the horsepower per pound of motor weight is less than it would be for an induction motor. Also, the rotor is dynamically unbalanced since its center traces a circular orbit as it moves circumferentially towards the activated windings due to magnetic attraction as it follows the rotating field while points on the rotor go through a hypocycloid motion. The unbalance forces increase with the square of the rotor speed thus making the motor unsuitable for high speed applications.

SUMMARY OF THE INVENTION

As the external annular rotor rolls around the stator in its coaction as a rolling rotor motor, it also coacts with one or more vanes and an external housing to define a rolling piston compressor. This configuration does not produce any interruption in the magnetic force field in the stator and the stator does not form a part of the compression chamber. The sealing and lubrication between the rotor/piston and the housing/cylinder would be the conventional sealing and lubrication structure for a rolling piston compressor.

It is an object of this invention to improve the utilization of motor material in a rolling rotor motor/compressor.

It is an additional object of this invention to have the compression volume separate from the stator so that no special surface need by applied to the outer surface of the stator.

It is another object of this invention to provide a compressor that can be readily designed for either single or two stage operation.

It is further object of this invention to eliminate any interruption in the magnetic force path of a rolling rotor motor. These objects, and others as will become apparent hereinafter, are accomplished by the present invention.

Basically, the external rotor of a rolling rotor motor functions as the piston of a rolling piston compressor. A housing serves as the cylinder of the compressor as well as defining a hermetic shell for the motor/compressor. A vane coacts with the rotor and housing to define a compression chamber. In a two cylinder embodiment two diametrically located vanes are employed to establish two compression chambers and thereby even out the flow and reduce gas pulsations. In a two stage embodiment two vanes are approximately 120° apart.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
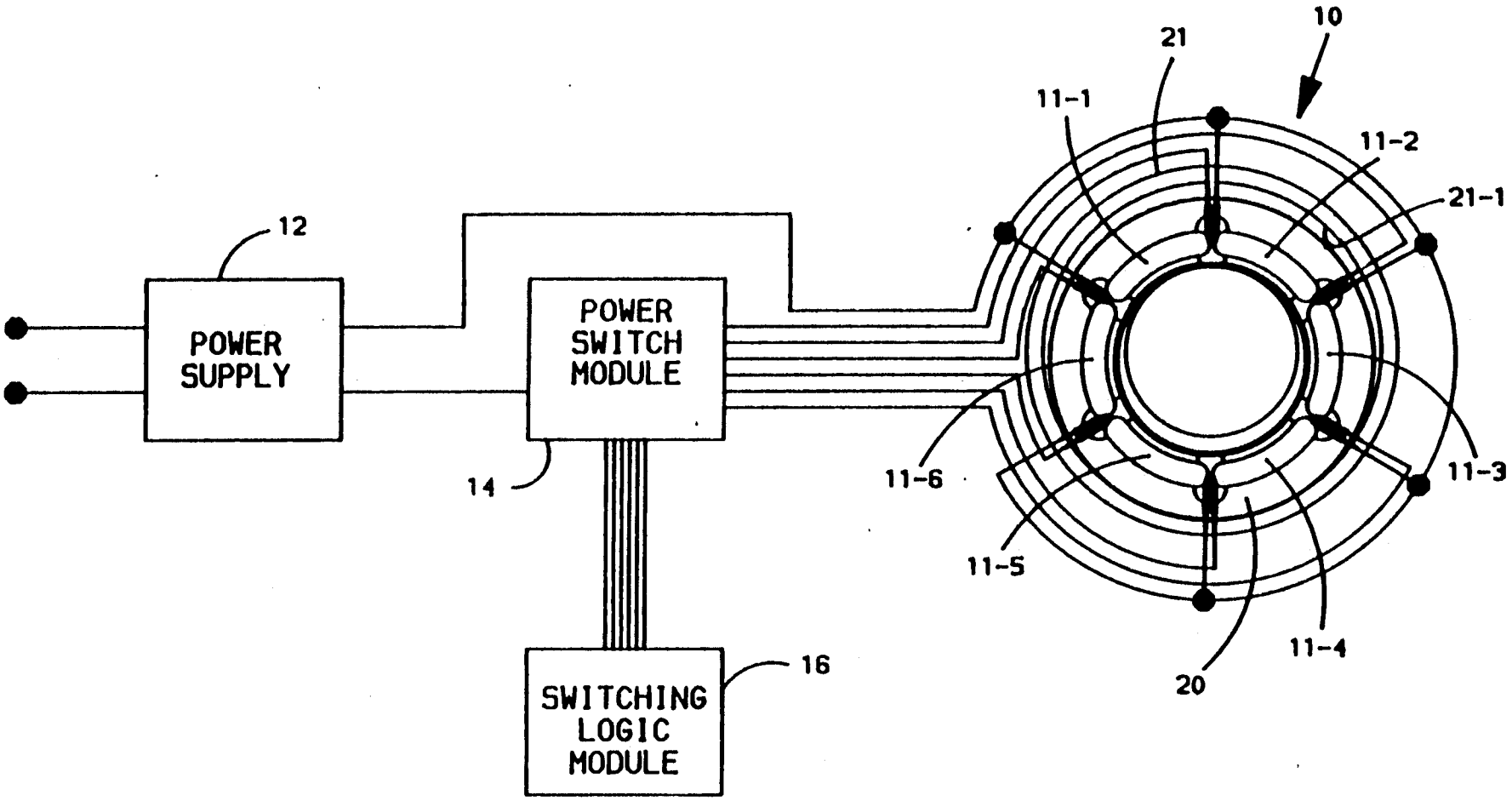
FIG. 1 is a circuit diagram for a rolling rotor motor/compressor.
Figure 2:
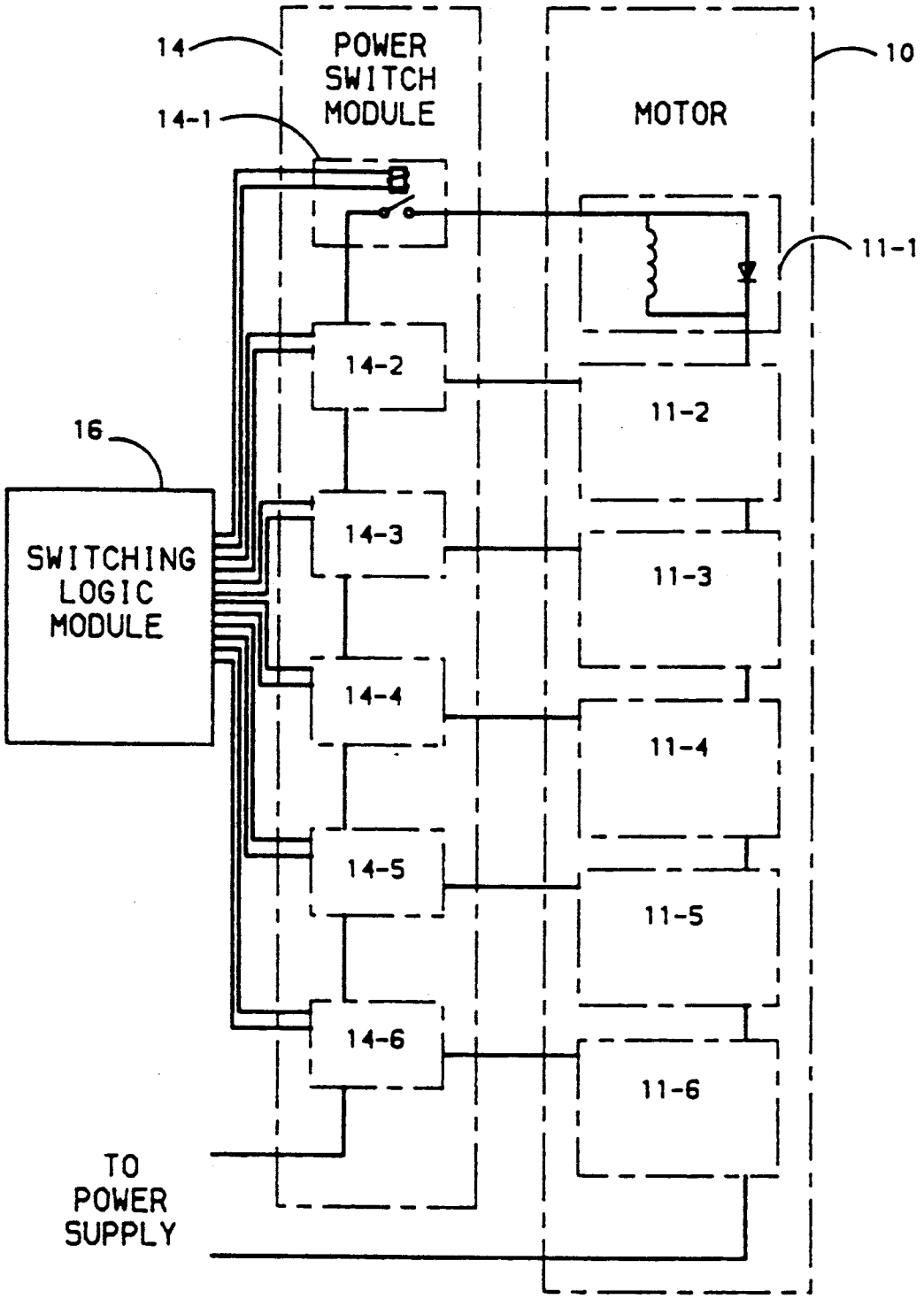
FIG. 2 is a more detailed view of the switching portion of the circuit of FIG. 1.
Figure 3:
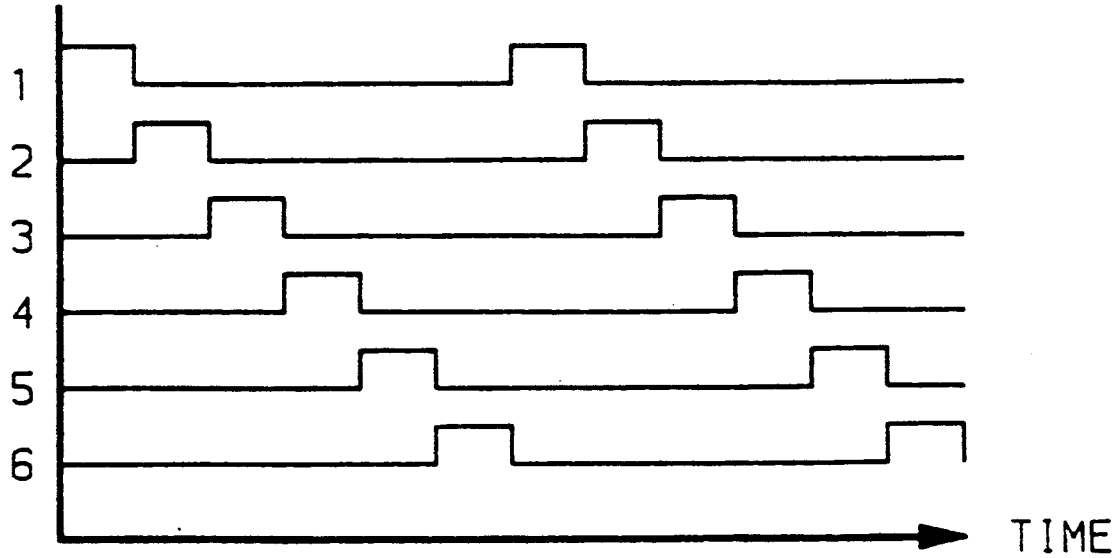
FIG. 3 is a graph showing the actuation of the switches as a function of time in the on at off mode.
Figure 4:
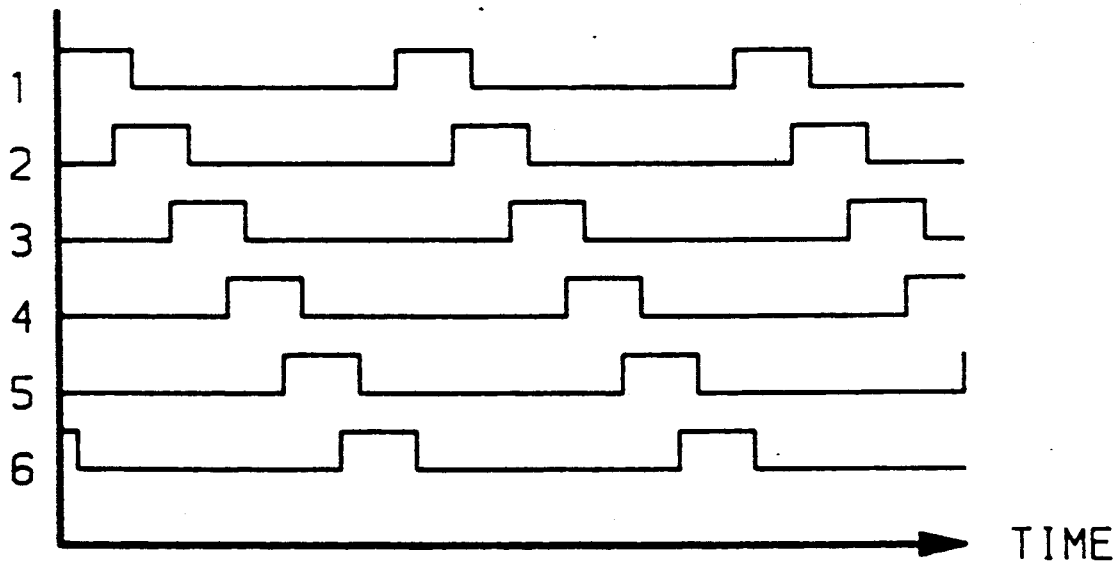
FIG. 4 is a graph showing the actuation of the switches as a function of time in the on before off mode.

In FIG. 1 the numeral 10 generally designates a rolling rotor motor/compressor which has a plurality of windings with six, 11-1 to 6, being illustrated. Power from power supply 12 is supplied to windings 11-1 to 6 by power switch module 14 under the control of switching logic module 16. Referring to FIG. 2, it will be noted that the power supply 12 is connected to windings 11-1 to 6 through switches 14-1 to 6 which are controlled by switching logic module 16. Switch 14-1 is illustrated as solenoid actuated but any suitable power switching may be employed. Switches 14-1 to 6, as illustrated in FIG. 3, can be actuated in an "on at off" mode wherein the shutting off of power to one winding coincides with the supplying of power to the next winding. Alternatively, as illustrated in FIG. 4, switches 14-1 to 6 can be actuated in an "on before off" mode wherein power is supplied to a winding for a short period of time after power is supplied to the next winding.

Figure 5:
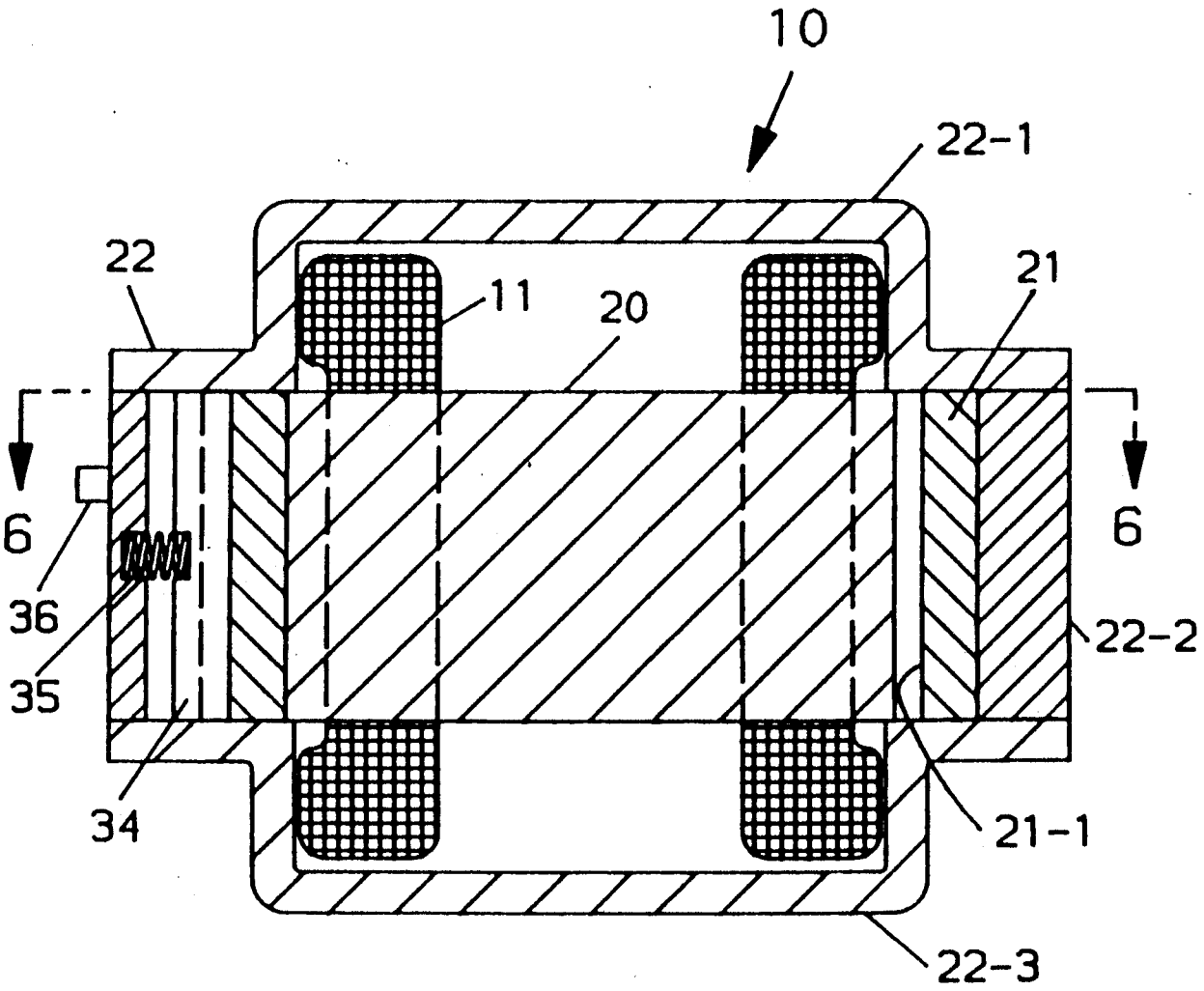
FIG. 5 is a vertical section of a rolling rotor motor/compressor taken along line 5—5 of FIG. 6.
Figure 6:
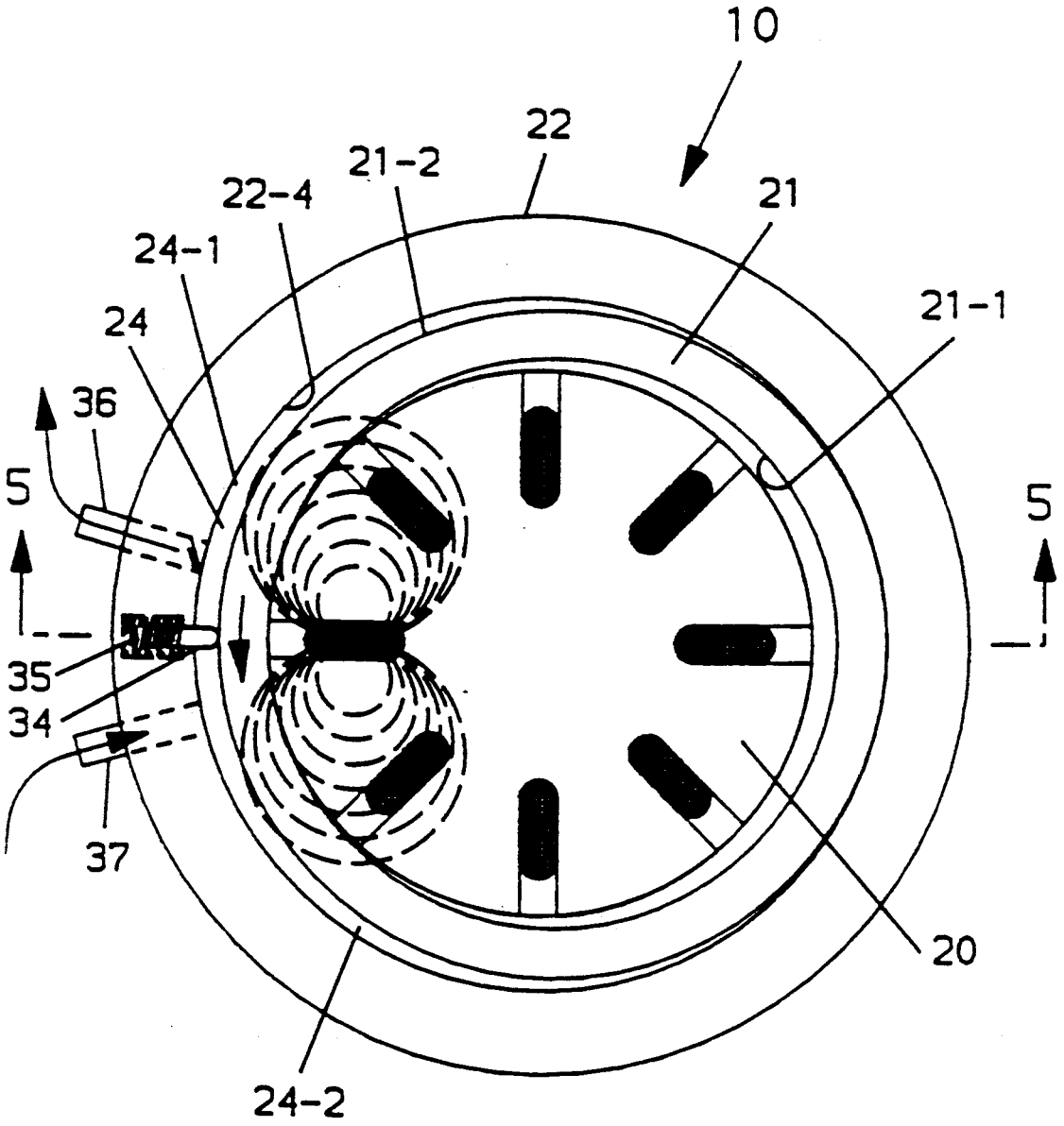
FIG. 6 is a horizontal section taken along line 6—6 of FIG. 5.

In FIGS. 5 and 6 the numeral 10 generally designates a rolling rotor motor/compressor which includes a stator 20 with windings 11 and an annular rotor/piston 21. Rotor 21 has a bore 21-1 in which stator 20 is located. Rotor 21 and stator 20 are located within hermetic shell or housing 22 which includes upper, middle, and lower portions 22-1 to 3, respectively. Middle portion 22-2 defines the cylinder of the compressor while upper and lower portions 22-1 and 22-3 coact with rotor/piston 21 to provide a fluid seal while permitting movement of the rotor/piston 21.

In operation, as the magnetic field moves about the stator 20 through the selective activation of some of the windings, as described above, rotor/piston 21 tends to follow the magnetic field and the inner surface of bore 21-1 coacts with the outer surface of stator 20 in the manner of the coaction of the piston and cylinder of a rolling piston compressor. Simultaneously, the outer surface 21-2 of rotor/piston 21 coacts with the inner surface of bore 22-4 in middle portion 22-2 in the nature of the coaction of the piston and cylinder of a rolling piston compressor. As a result, the inner surface of bore 21-1 in rotor/piston 21 is in line or tangential contact with the outer surface of stator 20 and at a diametrically located point the outer surface 21-2 of annular rotor/-piston 21 is in line or tangential contact with the inner surface of bore 22-4 in middle portion 22-2 which defines the cylinder. However, the vane 34 which is necessary for compressor operation and is biased by spring 35 is located in middle portion/cylinder 22-2 and coacts with the outer surface 21-2 of rotor/piston 21 to divide the lunette shaped space 24 between rotor/piston 21 and bore 22-4 into a suction chamber 24-1 and a discharge chamber 24-2. Thus, for compressor operation, refrigerant at suction pressure is supplied from the refrigeration system (not illustrated) via line 36 to suction chamber 24-1 and refrigerant at discharge pressure is supplied to the refrigeration system (not illustrated) from discharge chamber 24-2 via line 37 in the conventional manner for a rolling piston compressor due to the coaction of rotor/piston 21, bore 22-4 and vane 34.

Figure 7:
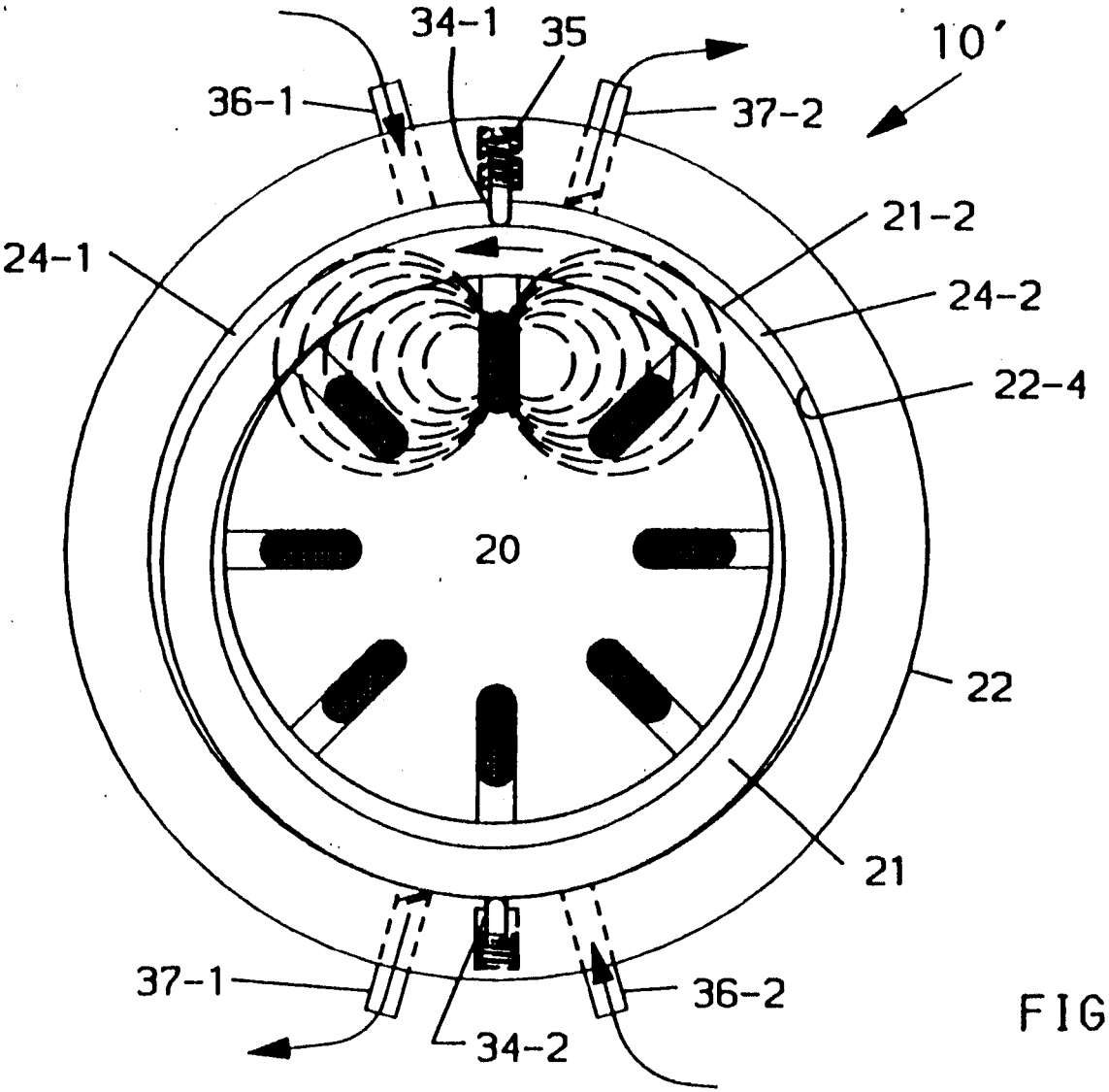
FIG. 7 is a horizontal section of a modified rolling rotor motor/compressor in a two cylinder configuration.

The rolling rotor motor/compressor 10' of FIG. 7 is structurally identical to the rolling rotor motor/compressor 10 of FIGS. 1–6 except for the addition of structure necessary for two pumping chambers to achieve two cylinder operation. Specifically, vanes 34-1 and 2 coact with the outer surface 21-2 of rotor/piston 21 to divide the lunette shaped space 24 into chambers 24-1 and 2 which, in turn, are divided into suction and discharge chambers responsive to the coaction between piston/rotor 21 and bore 22-4. Thus for compressor operation, refrigerant at suction pressure is supplied from the refrigeration system (not illustrated) via suction lines 36-1 and 2, respectively, to the suction chambers defined in chambers 24-1 and 2. Refrigerant at discharge pressure is supplied to the refrigeration system (not illustrated) via discharge lines 37-1 and 2, respectively, from the discharge chambers defined in chambers 24-1 and 2 in the conventional manner for a rolling piston compressor due to the coaction of rotor/-piston 21, bore 22-4 and vanes 34-1 and 2.

Figure 8:
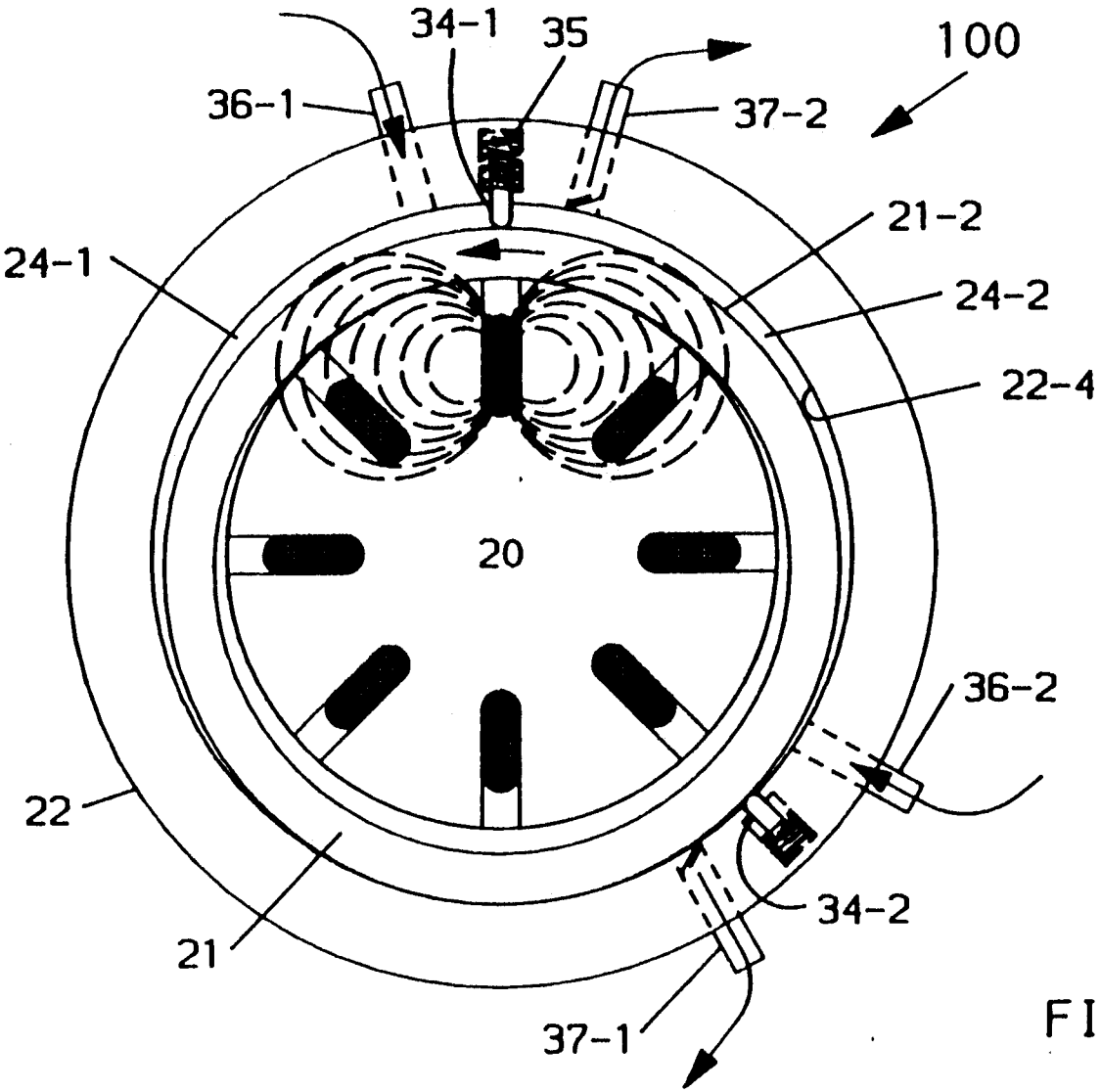
FIG. 8 is a horizontal section of a modified rolling rotor motor/compressor in a two stage configuration.

The rolling rotor motor compressor 100 of FIG. 8 is structurally identical to the rolling rotor motor/compressor 10' of FIG. 7 except for the relative positions of vanes 34-1 and 2. Specifically, vanes 34-1 and 34-2 are asymmetrically located, such as 120° apart, rather than being diametrically located. For example, first stage chamber 24-1 may extend for 240° and second stage chamber 24-2 may extend for 120°. Compressor 100 can be used in two different cycles. In the first cycle, the flow from the larger chamber 24-1 is pumped into the smaller chamber 24-2 to meet the needs of a system requiring a large pressure rise while maintaining the best efficiency and capacity. In the second cycle, an economizing cycle is achieved by connecting chamber 24-1, which has the larger volume, to the lower pressure source, while chamber 24-2, which has the smaller volume, is connected to an intermediate pressure source. Chambers 24-1 and 2 would discharge into a common discharge pressure source. This cycle provides for both enhanced capacity and efficiency.

Although preferred embodiments of the present invention have been illustrated and described, other changes will occur to those skilled in the art. It is therefore intended that the scope of the present invention is to be limited only by the scope of the appended claims.

What is claimed is:

1. A rolling rotor motor/compressor means comprising:

hermetic housing means having an inner cylindrical surface and means for supplying gas to said housing means and for delivering gas from said housing means;

stator means within said housing means and having a plurality of selectively activated windings;

annular rotor means within said housing means and surrounding said stator means so as to coact therewith to define a rolling rotor motor means and having an inner cylindrical surface and an outer cylindrical surface such that when some of said windings are activated said inner cylindrical surface of said rotor means is in line contact with said stator means and at a diametrically opposed point said outer cylindrical surface of rotor means is in line contact with said inner cylindrical surface of said housing means; and vane means including two circumferentially spaced vanes reciprocatably supported in said housing means and extending through said inner cylindrical surface of said housing means, said inner cylindrical surface of said housing means coacting with said outer cylindrical surface of said rotor means, said vane means and means for supplying and delivering gas to define a rolling piston compressor means driven by said rolling rotor motor means.

2. The rolling rotor motor/compressor means of claim 1 wherein said two vanes are diametrically opposed.

3. The rolling rotor motor/compressor means of claim 1 wherein said vanes are asymmetrically located for staged operation.

4. A rolling rotor motor/compressor means comprising:

hermetic housing means having an inner cylindrical surface defining a compressor bore and means for supplying gas to said compressor bore and for delivering compressed gas therefrom;

vane means including two circumferentially spaced vanes reciprocatably supported in said housing means and biased towards said compressor bore;

annular piston means within said housing means having an outer cylindrical surface for coacting with said inner cylindrical surface and said vane means to define a rolling piston compressor;

stator means within said annular piston means and separated thereby from said compressor bore;

said stator means having a plurality of selectively activated windings such that when some of said windings are activated said annular piston means defines a rotor means and an inner cylindrical surface thereof is in line contact with said stator means and at a diametrically opposed point said outer cylindrical surface of said annular piston means is in line contact with said compressor bore.

5. The rolling rotor motor/compressor means of claim 4 wherein said two vanes are diametrically opposed.

6. The rolling rotor motor/compressor means of claim 4 wherein said vanes are asymmetrically located for two stages operation.

7. The rolling rotor motor/compressor means of claim 4 wherein said vanes are asymmetrically located for staged operation.

* * * * *